US010073488B2

(12) United States Patent
Conro et al.

(10) Patent No.: US 10,073,488 B2
(45) Date of Patent: Sep. 11, 2018

(54) MULTIFUNCTION JOYSTICK APPARATUS AND A METHOD FOR USING SAME

(71) Applicant: Grayhill, Inc., La Grange, IL (US)

(72) Inventors: Christopher Michael Conro, Elgin, IL (US); Stephen Alan Kozich, Glen Ellyn, IL (US)

(73) Assignee: Grayhill, Inc., La Grange, IL (US)

( * ) Notice: Subject to any disclaimer, the term of this patent is extended or adjusted under 35 U.S.C. 154(b) by 636 days.

(21) Appl. No.: 14/483,386

(22) Filed: Sep. 11, 2014

(65) Prior Publication Data

US 2016/0077543 A1 Mar. 17, 2016

(51) Int. Cl.
*G05G 9/047* (2006.01)

(52) U.S. Cl.
CPC ... *G05G 9/047* (2013.01); *G05G 2009/04755* (2013.01); *G05G 2009/04759* (2013.01)

(58) Field of Classification Search
CPC ..... G05G 9/047; G05G 2009/04755; G05G 2009/04759
See application file for complete search history.

(56) References Cited

U.S. PATENT DOCUMENTS 5,657,012 A 8/1997 Gilmour
5,831,554 A 11/1998 Hedayat et al.
5,831,596 A 11/1998 Marshall et al.
6,059,660 A 5/2000 Takada et al.
6,580,418 B1 6/2003 Grome et al.
6,606,085 B1 8/2003 Endo et al.
7,019,732 B2 3/2006 Furukawa
7,265,304 B2 9/2007 Ichiki et al.
7,429,977 B2 9/2008 Edmunds
7,433,760 B2 10/2008 Alvarez et al.
7,474,296 B2 1/2009 Obermeyer et al.
7,595,712 B2 * 9/2009 Nishino ..... G05G 9/047 200/302.3
8,083,590 B2 12/2011 Nourry
8,094,121 B2 1/2012 Obermeyer et al.
8,164,405 B2 * 4/2012 Hsu ..... H01H 25/002 335/205
8,264,458 B2 9/2012 Cooper et al.
8,344,834 B2 1/2013 Nilyama
8,344,914 B2 1/2013 Yeh
8,345,005 B2 1/2013 Jaouen
2004/0222965 A1 11/2004 Riccomini et al.
(Continued)

*Primary Examiner* — Bernard Rojas
(74) *Attorney, Agent, or Firm* — K&L Gates, LLP

(57) ABSTRACT

A joystick apparatus has a housing and a printed circuit board in the housing. A shaft is pivotably connected to a U-joint assembly to allow movement of the shaft relative to the center position within a circle. A concentric reduced power zone circle is associated with the circle. Operation of the joystick within the reduced power zone circle uses less power than operation outside of the reduced power zone. A knob and a magnet are located on the shaft. A Hall effect integrated circuit detects movement of the magnet in response to corresponding movement of the shaft by a user and generates a corresponding proportional joystick output signal indicative of a direction and an extent of rotation of the shaft. A multifunction joystick control system has a joystick configured to provide multiple operational modalities on a joystick. An electrical interface connects the joystick apparatus and the host central processing unit.

12 Claims, 8 Drawing Sheets

(56) References Cited

U.S. PATENT DOCUMENTS

| | | | | |
|---|---|---|---|---|
| 2005/0195166 | A1 | 9/2005 | Cooper et al. | |
| 2011/0163957 | A1 | 7/2011 | Jaouen | |
| 2012/0162076 | A1 | 6/2012 | Obermeyer et al. | |
| 2014/0024110 | A1* | 1/2014 | Knofe | B25J 13/02 435/325 |
| 2016/0202721 | A1* | 7/2016 | Bernardy | G06F 3/038 74/471 XY |

* cited by examiner

| BIT 7 | BIT 6 | BIT 5 | BIT 4 | BIT 3 | BIT 2 | BIT 1 | BIT 0 |
|---|---|---|---|---|---|---|---|
| X(7)SIGN | X(6)MSB | X(5) | X(4) | X(3) | X(2) | X(1) | X(0)LSB |
| R | R | R | R | R | R | R | R |

| BIT 7 | BIT 6 | BIT 5 | BIT 4 | BIT 3 | BIT 2 | BIT 1 | BIT 0 |
|---|---|---|---|---|---|---|---|
| Y(7)SIGN | Y(6)MSB | Y(5) | Y(4) | Y(3) | Y(2) | Y(1) | Y(0)LSB |
| R | R | R | R | R | R | R | R |

| BIT 7 | BIT 6 | BIT 5 | BIT 4 | BIT 3 | BIT 2 | BIT 1 | BIT 0 |
|---|---|---|---|---|---|---|---|
| X | X | X | X | X | X | RESET | X |
| | | | | | | W | |

MULTIFUNCTION JOYSTICK APPARATUS AND A METHOD FOR USING SAME

BACKGROUND OF THE INVENTION

The present invention generally relates to a joystick input and control apparatus and a method for using same. The joystick provides control signals for controlling devices, machinery, computer games, or the like. More specifically, the present invention relates to a joystick apparatus that may be configured in various embodiments to provide a multifunction joystick for a particular application and/or for a variety of devices.

Joysticks may be used to provide input control signals for controlling, for example, machinery, devices and computer application programs, such as computer games. A typical joystick has a handle that is pivotally rotatable about a base, producing an output signal corresponding to the angular displacement of the handle about orthogonal "X" and "Y" axes. The output signal from a joystick may typically be an input to a host device, such as a computer, which processes the signal. The signal may be used to control hardware or to provide an input command to a computer software program.

Joysticks are generally designed to function as either on/off devices or proportional devices. Lower-cost on/off devices operate positional switches to provide an indication of whether a minimum displacement of the control handle about one or both axes of the joystick has occurred; and proportional devices provide output signals having a magnitude corresponding to a proportional displacement of the joystick control handle away from a known point, generally its "center" point. Higher performance software applications, such as flight simulators, require the use of joysticks that provide proportional output signals.

In addition to providing X-axis and Y-axis input signals to a computer or other device, some joysticks may additionally provide input signals corresponding to a third input axis, which is commonly referred to as the Z-axis. The Z-axis generally corresponds to the centerline of the control handle of the joystick, and the Z-axis output signal typically is indicative of a rotational angular displacement of the joystick handle about its centerline.

In general, most joysticks may also have electromechanical position sensors to measure rotation of the joystick control handle relative to its central position. In certain joysticks having a shaft and ball, the rotation of the control handle about or linear displacement in the direction of the X-axis and Y-axis may be measured using electromechanical position sensors, such as rotary or linear potentiometers, optical encoders, and the like, which are coupled to the shaft and/or ball in various ways. Optical position sensors may also be used for monitoring the position of a joystick control handle.

Further, joysticks may be used in many different applications. For example, some applications in which joysticks may be used on medical devices, material handling vehicles, mobile electronics for outdoor use, industrial machinery, consumer electronics, gaming, flight simulators and the like. Existing joysticks may have different functions, levels of complexity and/or performance. Some joysticks are relatively simple and provide basic levels of performance. However, due to their simplicity and corresponding relatively low levels of performance, such joysticks may adversely affect the operation of the device. Such simple joysticks have numerous limitations. For example, such joysticks may not be capable of precise and/or accurate control of the devices. Also, some of the simpler joysticks lack adjustability and/or adaptability for different applications. The performance of the device may also be adversely impacted when such a limited joystick is used. Consequently, device operation and/or user satisfaction and/or user safety may be negatively impacted when the joystick is inadequate. Thus, many of the existing joysticks may be inadequate for controlling the performance of a device and/or may cause numerous performance and/or safety problems when operating a device.

Alternatively, other existing joysticks provide much higher performance. However, the increase in complexity with such systems invariably may result in increased costs and/or reliability issues. Accordingly, it would be beneficial to provide a joystick that does not have these limitations.

Therefore, a need exists for a joystick apparatus that may be configured in various embodiments to provide a multifunction joystick for a particular application and/or for a variety of devices.

SUMMARY OF THE INVENTION

The present invention generally relates to a joystick apparatus and a method for using same. More specifically, the present invention relates to a joystick apparatus that may be configured in various embodiments to provide a multifunction joystick for a particular application and/or for a variety of devices.

To this end, in an embodiment, a joystick apparatus is provided. The apparatus has a housing and a printed circuit board in the housing. A U-joint assembly is positioned above the printed circuit board and has a U-joint rocker pivotably connected to a U-joint slider. The apparatus also has a shaft having a first end, a second end and a center position. The second end is pivotably connected to the U-joint rocker to allow movement of the shaft relative to the center position within a circle. The movement of the shaft is in at least one of a forward and a backward direction, a side-to-side direction, an axial direction or a rotating direction to provide an end user with selectable functionality. The apparatus further has a knob on the first end of the shaft and a magnet on the second end of the shaft. Finally, the joystick apparatus has a Hall effect integrated circuit (IC) on the printed circuit board that detects movement of the magnet in response to corresponding movement of the shaft and generates a corresponding proportional joystick output signal indicative of the direction of movement of the shaft and extent of deflection of the shaft.

In an embodiment, the apparatus has a concentric reduced power zone circle inside the circle of movement of the shaft. Operation of the shaft inside the reduced power zone circle uses less power in comparison to operation outside of the reduced power zone circle.

In an embodiment, the U-joint slider is configured to slide vertically in the housing in response to a user axially pressing the knob.

In an embodiment, the apparatus has a dome contact on the printed circuit board wherein the U-joint slider contacts the dome contact to close an electrical circuit in response to a user pressing axially on the knob.

In an embodiment, the apparatus has a torsion spring between the housing and the U-joint slider to return the shaft to the center position in response to a user rotating the knob.

In an embodiment, the apparatus has a reflector at a center position on the U-joint slider, and a first optical switch and a second optical switch on the printed circuit board. Each of the first optical switch and the second optical switch is arranged on a respective side of the center position of the reflector. Each of the first optical switch and the second optical switch completes, such as by closing, an electrical circuit in response to a user rotating the knob to align the reflector with one of the first optical switch and the second optical switch.

In an embodiment, the apparatus has a shaft gater on the housing wherein the shaft passes through an opening in the shaft gater.

In an embodiment, the apparatus has a slave microcontroller associated with the printed circuit board and an electrical interface connecting the slave microcontroller.

In an embodiment, the apparatus has a sealing boot having an opening and a lip. The first end of the shaft passes through the opening, and the lip abuts the housing.

In an embodiment, the apparatus has a sealing boot overmolded onto an insert. The sealing boot is silicone rubber, and the insert is plastic.

In an embodiment, the apparatus has a centering plunger on the shaft, and a spring on the centering plunger to return the shaft to the center position in response to a user moving the shaft.

In an embodiment, the apparatus has keying features in the housing to facilitate alignment during assembly.

In an embodiment, the apparatus has keying features to allow the U-joint slider to move axially along the shaft axis and to restrict rotation of the U-joint slider relative to the housing for pushbutton operation.

In an embodiment, the apparatus has keying features to allow the U-joint slider to move axially along the shaft axis for pushbutton operation and to allow rotation of the U-joint slider relative to the housing for rotation operation.

In another embodiment of the invention, a method for providing a plurality of functions on a joystick apparatus is provided. The method has the steps of providing a configurable modular structure of the joystick apparatus; and modifying the structure to enable a plurality of operations on a single shaft of the joystick apparatus.

In an embodiment, the method has the step of modifying the structure of the joystick apparatus to enable pushbutton operation of the joystick apparatus.

In an embodiment, the method has the step of modifying the structure of the joystick apparatus to enable pivoting operation of the joystick apparatus in a backward direction and a forward direction and in a side-to-side direction.

In an embodiment, the method has the step of modifying the structure of the joystick apparatus to enable operation of the joystick apparatus in a rotating manner.

In an embodiment, the method has the step of configuring the structure of the joystick apparatus to provide pushbutton operation, rotational operation, pivoting operation in a forward direction and a backward direction and a pivoting operation in a side-to-side direction.

In another embodiment, a multifunction joystick control system is provided. The system has an interchangeable housing that is selectively adapted to provide pushbutton operation, rotational operation, pivoting operation in at least one of a forward direction and a backward direction and pivoting operation in a side-to-side direction. The system also has a shaft having a first end, a second end and a center position. The shaft is movably attached to the housing at the second end to allow movement of the shaft relative to the center position. A knob is positioned at the first end of the shaft. Movement of the knob is translated into a proportional control signal indicative of the movement of the shaft.

It is, therefore, an advantage of the present invention to provide a joystick apparatus that provides for interchangeability of function.

Another advantage of the present invention is to provide a configurable structure of the joystick apparatus enabling the ability to create any one, two or three functions on a single shaft of a push-button type joystick and/or a pivoting joystick in an up/down direction and/or a side-to-side direction and/or a rotating/swivel joystick that provides an end user with selectable functionality for use of the joystick.

Another advantage of the present invention is to provide a joystick apparatus having a low power sleep zone.

Another advantage of the present invention is to provide a joystick apparatus having a low power mode of operation.

Still another advantage of the present invention is to provide a joystick apparatus that is configurable to provide multiple functions on a single shaft of a joystick.

A further advantage is to provide a joystick apparatus capable of distinguishing between actual activation of the joystick and vibrations and/or other minor disturbances to the joystick.

Additional features and advantages of the present invention are described in, and will be apparent from, the detailed description of the presently preferred embodiments and from the drawings.

DETAILED DESCRIPTION OF THE PREFERRED EMBODIMENTS

The present invention generally relates to a joystick apparatus and a method for using same. More specifically, the present invention relates to a joystick apparatus that may be configured in various embodiments to provide a multi-function joystick for a particular application and/or for a variety of devices.

To this end, in an embodiment, a joystick apparatus is provided. The apparatus has a housing and a printed circuit board in the housing. A U-joint assembly is positioned above the printed circuit board and has a U-joint rocker pivotably connected to a U-joint slider. The apparatus also has a shaft having a first end, a second end and a center position. The second end is pivotably connected to the U-joint rocker to allow movement of the shaft relative to the center position within a circle. The movement of the shaft is in at least one of a forward and a backward direction, a side-to-side direction, an axial direction or a rotating direction to provide an end user with selectable functionality. The apparatus further has a knob on the first end of the shaft and a magnet on the second end of the shaft. Finally, the joystick apparatus has a Hall effect integrated circuit (IC) on the printed circuit board that detects movement of the magnet in response to corresponding movement of the shaft and generates a corresponding proportional joystick output signal indicative of the direction of movement of the shaft and an extent of rotation of the shaft.

Figure 1:
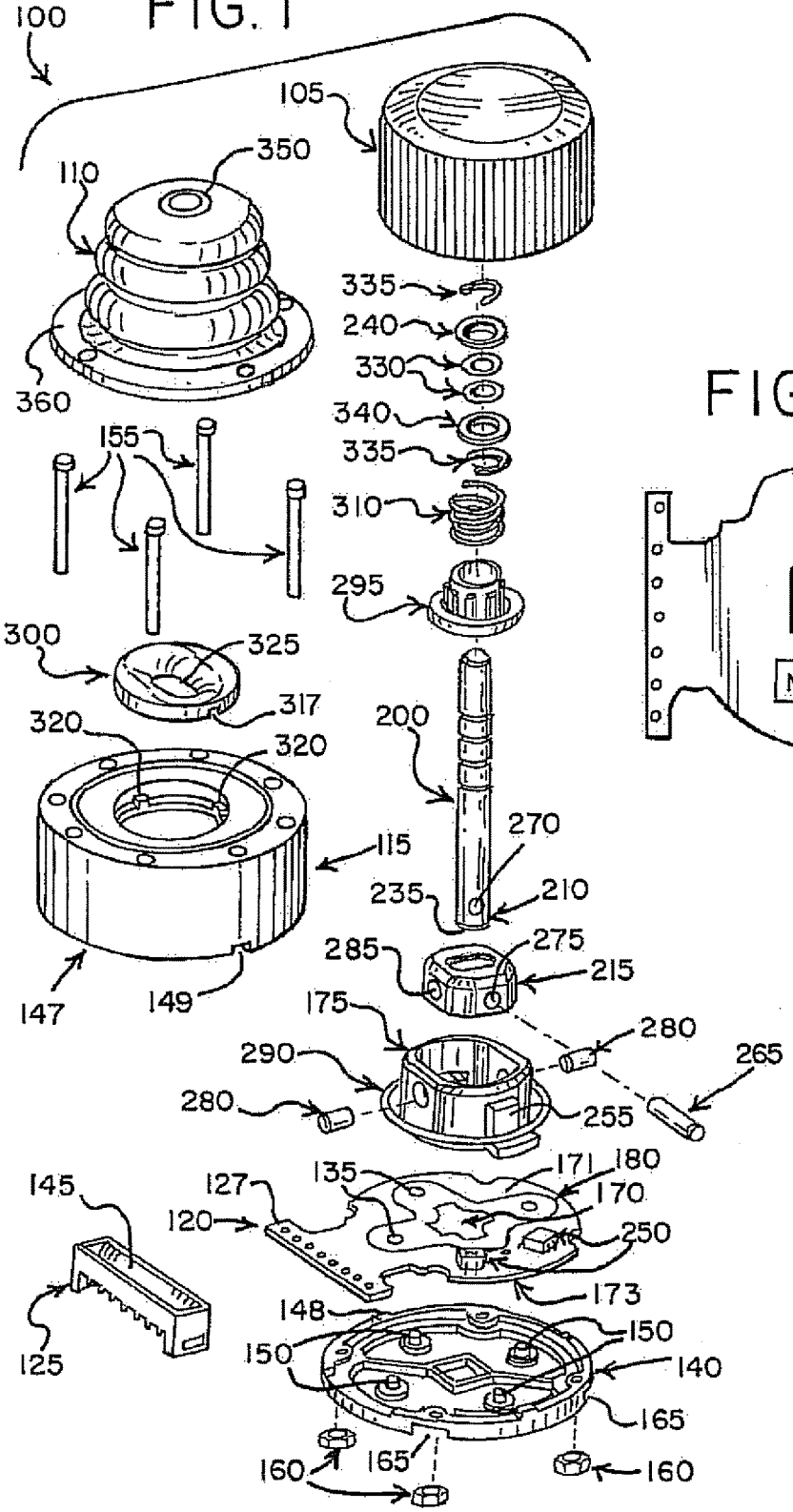
FIG. 1 is an exploded view of a joystick apparatus in an embodiment of the present invention.

Referring now to the drawings wherein like numerals refer to like parts, FIG. 1 is a corresponding exploded view of an embodiment of the joystick apparatus 100 illustrating additional internal components in an embodiment of the joystick apparatus 100.

As shown in FIG. 1, the joystick apparatus 100 may have a knob 105. The knob 105 may be made from plastic. The joystick apparatus 100 may also have a sealing boot 110 made from silicone rubber or similar material. Further, the joystick apparatus 100 may have a joystick housing 115. In an embodiment, the joystick housing 115 may be made from plastic. The joystick housing 115 may act as the structural center of the joystick apparatus 100. The joystick housing 115 may provide attachment, assembly and/or location capabilities and/or features for various other components of the joystick apparatus 100.

The joystick apparatus 100 may also have a printed circuit board (PCB) 120. The PCB 120 may be made from FR4 with copper and/or gold plating. FR4 is a grade designation assigned to glass-reinforced epoxy laminated printed circuit boards. FR4 is a composite material composed of woven fiberglass cloth with an epoxy resin binder that may be flame resistant and/or self-extinguishing. The PCB 120 is a substrate onto which the switch circuitry is laid. The PCB 120 may be an attachment point for a strain relief 125 and a cable assembly 130 (see FIG. 6). The strain relief 125 may also be made from plastic. The strain relief 125 may attach to a protrusion 127 on the PCB 120. The cable assembly 130 for the joystick apparatus 100 may pass through an opening 145 in the strain relief 125 which may prevent undue stress from being applied to solder joints on the cable assembly 130, in the event that the cable assembly 130 is pulled or jerked. The PCB 120 may also have holes 135 arranged in a pattern which may align the position of the PCB 120 and may secure the PCB 120 to a backplate 140.

The backplate 140 may be made from plastic. The backplate 140 may attach to an underside 147 of the joystick housing 115 and may be keyed to the joystick housing 115 by poka-yoke features to prevent incorrect assembly orientation. A tab 148 may be formed on the backplate 140, and a corresponding notch 149 may be provided in the housing 115. The backplate 140 may also serve to locate and secure the PCB 120. As a result, the backplate 140 may be fixedly attached and/or on-center in the joystick housing 115. Posts 150 may be provided on the backplate 140 as shown in FIG. 1. In the embodiment illustrated in FIG. 1, the four posts 150 in the backplate 140 may align the backplate 140 with the corresponding pattern of holes 135 in the PCB 120. After assembly, the posts 150 in the backplate 140 may be heat-staked so that the PCB 120 may be held in position and restrict movement of the PCB 120 relative to the backplate 140. The backplate 140 and the PCB 120 may then be assembled to the joystick housing 115, and the whole joystick assembly 100 may be secured by running assembly studs 155 through the joystick housing 115 and the backplate 140 and tightening hex nuts 160 to the assembly studs 155. The hex nuts 160 may be made from steel. The hex nuts 160 may be recessed into pockets 165 in the backplate 140 and tighten to the assembly studs 155 to connect the joystick apparatus 100. The assembly studs 155 may be made from steel. The assembly studs 155 may pass through the joystick housing 115 and the backplate 140. The assembly studs 155 may be held by the hex nuts 160 on the outside of the backplate 140. The assembly studs 155 may secure and/or connect the joystick apparatus 100.

Referring to the exploded view of an embodiment of the joystick apparatus 100 illustrated in FIG. 1, the component parts of the joystick apparatus 100 are shown in the relative orientations in which they may be assembled. For example, the backplate 140 may be oriented at the bottom of the assembly of the joystick apparatus 100. The PCB 120 may mount to the backplate 140. To facilitate the mounting and assembly of the two components, the posts 150 may be arranged in a pattern on the backplate 140 to align with the corresponding pattern of the holes 135 in the PCB 120.

The PCB 120 may also have other items affixed thereto. For example, the PCB 120 may have a dome contact 170. The dome contact 170 may be made from steel. The PCB 120 has a top surface 171 and a bottom surface 173. The dome contact 170 may be located on the top surface 171 of the PCB 120 and may be actuated by a U-joint slider 175 when a user presses down axially on the knob 105. The user may press downwardly or tap the knob 105 depending on the sensitivity of the joystick apparatus 100 in an embodiment. The force of the user input on the knob 105 is transferred through a shaft 200 to cause the U-joint slider 175 to physically contact and compress the dome contact 170. The dome contact 170 may provide an electrical switch closure when depressed and may also provide haptic feedback to the user. Also, a dome retaining sheet 180 may be assembled over the dome contact 170 and adhered to the top surface 171 of the PCB 120. The dome retaining sheet 180 may maintain the dome contact 170 in a fixed position beneath the actuator feature of the U-joint slider 175. The dome retaining sheet 180 may also prevent unwanted debris from interfering with the operation of the dome contact 170, which may prevent proper switch closure. The dome retaining sheet 180 may be made from an adhesive film.

A microcontroller 185 (shown in FIG. 2) may also be mounted on the PCB 120. In an embodiment, the microcontroller 185 may be mounted to the bottom surface 173 of the PCB 120. The microcontroller 185 on the PCB 120 of the joystick apparatus 100 may communicate with a host CPU 190 (shown in FIG. 6) via the cable assembly 130.

FIG. 1 also illustrates a shaft 200 that may be made from steel. The shaft 200 is a primary component of the joystick apparatus 100. For example, the shaft 200 may be the attachment point for the knob 105. Further, the shaft 200 may be one of the surfaces that may provide a seal for the shaft 200 and a panel (not shown). The shaft 200 also may hold a magnet 210. In an embodiment, the magnet 210 may be a critical component to the proportional joystick output.

Moreover, the shaft 200 may be attached to a U-joint slider 175, which also allows the shaft 200 to actuate joystick features of a pushbutton switch feature and a momentary rotation feature. Each feature is described hereinafter. The shaft 200 may be considered the center of the user interface; any input from the user is transmitted through the motion of the shaft 200 to various sensors on the PCB 120 discussed hereinafter.

The magnet 210 may be made from neodymium. The magnet 210 is a crucial component to the proportional joystick output, which uses a Hall effect integrated circuit ("IC") 230 (shown in FIG. 2) on the bottom surface 173 of the PCB 120 to detect changes in the position of the shaft 200. The Hall effect IC 230 may include an array of Hall sensors, for example. The magnet 210 may be assembled into a pocket 235 at the bottom of the shaft 200. User input to the shaft 200 may result in a corresponding motion of the magnet 210 which may be interpreted by the Hall effect IC 230 and may cause a change in an electrical output from the joystick apparatus 100 that corresponds to the motion of the shaft 200. The output may be proportional to a shaft input from the user. Thus, the greater the angle to which the shaft 200 is actuated, the greater the magnitude of the corresponding joystick output. Positioning and control information may be determined by the Hall effect IC 230 and processed by and sent from the microcontroller 185 to the host CPU 190 via the cable assembly 130.

Figure 11:
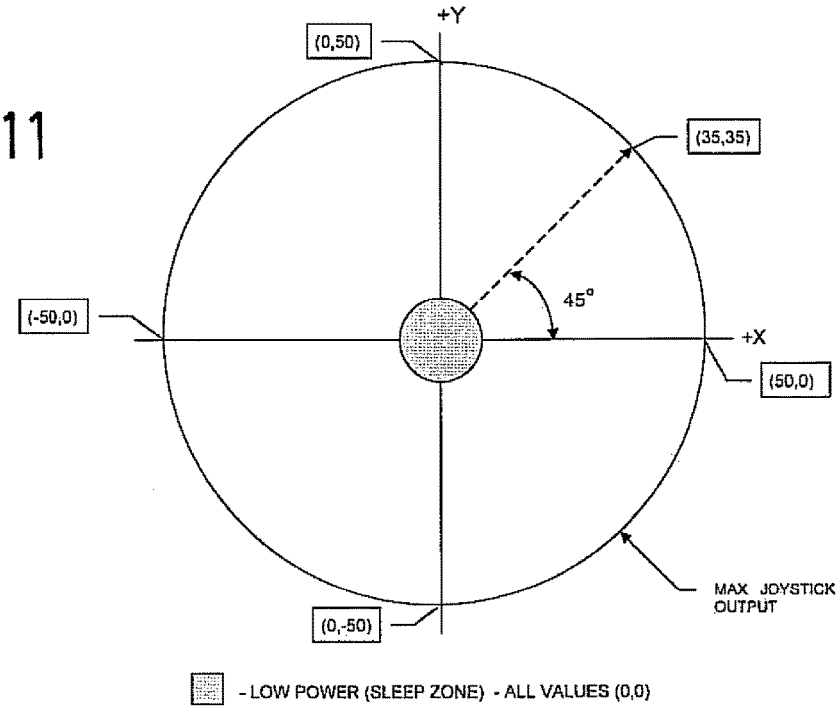
FIG. 11 is a graphical representation of a low power sleep zone and a maximum output circle for a joystick apparatus in an embodiment of the present invention.

In an embodiment of the invention, the microcontroller 185 may read an X coordinate and a Y coordinate of the joystick apparatus 100 from the Hall effect IC 230 and may adjust for mechanical offset from a center and/or non-actuated position of the shaft 200. Accordingly, the microcontroller 185 may determine if the joystick apparatus 100 is within a "sleep zone" as shown in FIG. 11. For example, if the joystick apparatus is within the "sleep zone," the microcontroller 185 may output (0,0). Alternatively, if the X coordinate and the Y coordinate of the joystick apparatus 100 may lie outside the "sleep zone" the microcontroller 185 may proportionately reduce the X coordinate and the Y coordinate of the joystick apparatus by the respective coordinates in the "sleep zone" circle along the same angle.

In an embodiment, the "sleep zone" circle may have coordinates. For example, a coordinate along the circumference of the "sleep zone" circle may have a defined X coordinate and Y coordinate of (13,13) at an angle of 45 degrees from the horizontal and/or X axis. Accordingly, for a value (28,28) from the Hall IC at an angle of 45 degrees, the microcontroller 185 may reduce by the defined X coordinate and Y coordinate along the circumference of the "sleep zone" circle to provide a final calculated output of (15,15).

Additionally, in an embodiment of the invention, coordinate values output by the microcontroller 185 regarding the position of the joystick apparatus 100 may be incremental. That is, coordinate values output may begin with small values such as (1,0) and/or (1,1) and increase toward larger values proportionate to movement and/or actuation of the joystick apparatus 100, rather than jumping from a small value immediately to a large value, for example, that may be along the circumference of the "sleep zone" circle.

Also, in an embodiment of the invention, if, after reducing the coordinate values read from the Hall effect IC 230 by the corresponding sleep zone coordinates, the resulting coordinates lie outside the maximum output circle and/or range of motion of the joystick apparatus 100 as shown in FIG. 11, the microcontroller 185 may further reduce the coordinate values to a value on the maximum output circle at the same angle as the coordinate values read by the Hall effect IC 230. For example, as shown in FIG. 11 a maximum Y position may be (0,50) and a maximum X position may be (50,0), For an angle of 45 degrees from the horizontal and/or X axis a point on the maximum range of motion of the joystick apparatus may be (35,35).

The Hall effect IC 230 may contain an indium compound semiconductor crystal, such as indium antimonide. Hall effect ICs used in motion sensing and motion limit switches may offer enhanced reliability in extreme environments. The Hall effect IC 230 and the magnet 210 do not use moving parts. Further, the Hall effect IC 230 does not require physical contact, for example, between the Hall effect IC 230 and the magnet 210, thus extending the life of the Hall effect IC 230 in comparison to traditional electromechanical switches. Additionally, the Hall effect IC 230 and/or the magnet 210 may be encapsulated in an appropriate protective material.

Figure 2:
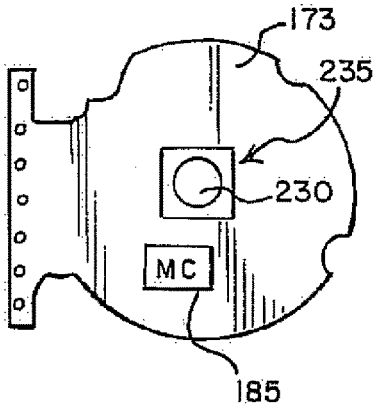
FIG. 2 is a bottom plan view of a printed circuit board and related components of an embodiment of the present invention.

The Hall effect IC 230 may be used to create a proportional joystick output that may correspond to the position of the shaft 200. The magnet 210 may reside in the pocket 235 in the base of the shaft 200. As the shaft 200 is moved during a joystick actuation by the user, the magnet 210 moves above the Hall effect IC 230 located under the PCB 120. The Hall effect IC 230 may be, for example, configured to detect and/or monitor minor fluctuations in magnetic flux density. The fluctuations in magnetic flux density may correspond to the position, rotation and/or deflection of the shaft 200 relative to, for example, the magnet 210. Further, the Hall effect IC 230 may have an internal central processing unit ("CPU") that may calculate an X coordinate and/or a Y coordinate for the position of the joystick apparatus 100 based on the magnetic flux measured by each Hall sensor in the array of Hall sensors in and/or on the Hall effect IC 230 as the shaft 200 and/or magnet 210 are moved. The Hall effect IC 230 may thus provide an electrical output proportional to the position, such as an angular position, of the shaft 200. As shown in FIG. 2, the illustrated embodiment shows the pocket 235 with, for example, a single Hall effect IC 230 located on the bottom surface 173 of the PCB 120 and may be directly on center. The Hall effect IC 230 may be located on the bottom surface 173 of the PCB 120 so the dome contact 170 is directly on center on the top side 171 of the PCB 120.

As set forth above, the PCB 120 may have various sensors. For example, the Hall effect IC 230 may be mounted on the bottom surface 173 of the PCB 120 to detect changes in the position of the shaft 200. Also, the PCB 120 may have optical switches 250 mounted on the top surface 171 of the PCB 120. The optical switches 250 may be used in an embodiment of the joystick apparatus 100 having a rotating feature described below. As shown in FIG. 1, two optical switches 250 may be mounted on the top surface 171 of the PCB 120, one on either side of a center position. When the shaft 200 is in the center position, a reflector 255 as shown in FIG. 1 on the U-joint slider 175 may be located above and between the two optical switches 250. When the user rotates the shaft 200 one way or the other, the reflector 255 may rotate along with the U-joint slider 175 until the reflector 255 is above one of the optical switches 250. Next, an electrical circuit associated with, for example, the shaft 200, the reflector 255, the optical switch 250 and/or the U-joint slider 175, may be closed. Turning the shaft 200 in the opposite direction may activate the other optical switch 250. The optical switches 250 may operate by having an emitter and a detector located side-by-side in a single surface mount die. When the reflector 255 is above the emitter, the infrared light that is emitted may be reflected back down onto the detector side that may close an electrical circuit associated with, for example, the reflector 255. In the absence of the reflector 255, the optical switch 250 may be, for example, be exposed.

As shown in FIG. 1, the joystick apparatus 100 may have a U-joint rocker 215. The U-joint rocker 215 may be made from plastic. The U-joint rocker 215 may provide the universal joint that allows the shaft 200 of the joystick apparatus 100 to pivot. A shaft pin 265 may pass loosely through a hole 270 in the shaft 200 and may be press-fit into holes 275 in the U-joint rocker 215. This configuration allows the shaft 200 to pivot in one direction. Also, the U-joint rocker 215 may be held by two shorter rocker pins 280 to the joystick housing 115. The rocker pins 280 may fit in holes 285 in the U-joint rocker 215 via holes 288 in the U-joint slider 175. The rocker pins 280 may run coplanar but perpendicular to the longer shaft pin 265. The fit between the rocker pins 280 and the U-joint rocker 215 may be loose, and the fit between the rocker pins 280 and the joystick housing 115 may be a press-fit. This assembly may allow the shaft 200 to pivot freely in any direction. Pushbutton actuation and rotation actuation may also be transmitted from the shaft 200 to the U-joint rocker 215, and subsequently, to the U-joint slider 175 which may move accordingly.

The rocker pins 280 may be made from steel. As previously set forth, the two rocker pins 280 may attach the U-joint slider 175 to the U-joint rocker 215 and may allow pivoting of the U-joint rocker 215. A press-fit between the rocker pins 280 and the U-joint slider 175 and a loose fit between the rocker pins 280 and the U-joint rocker 215 may be provided.

Figure 3A:
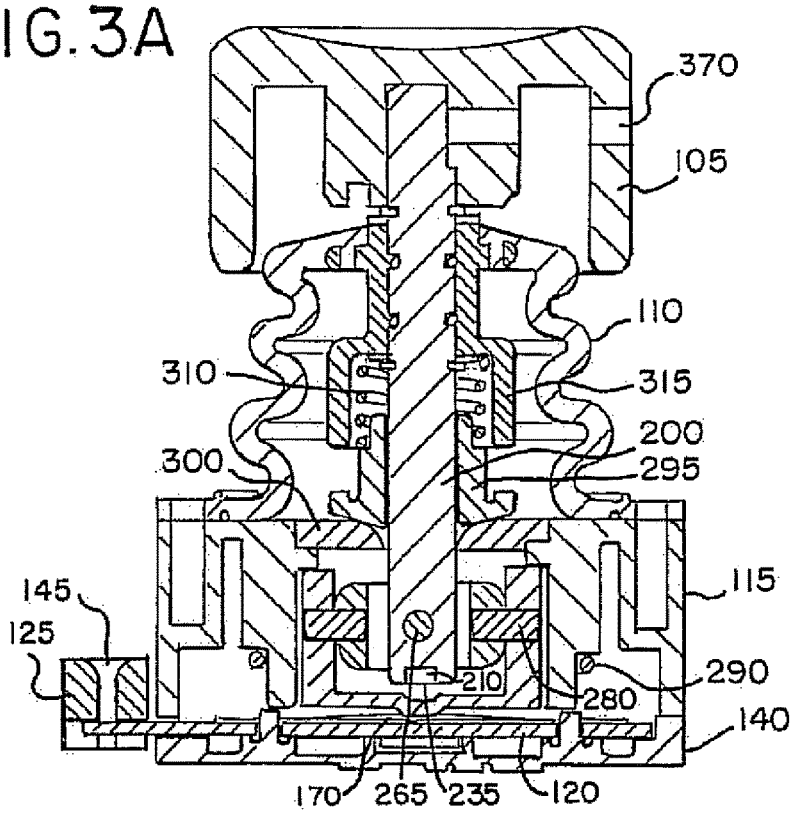
FIG. 3A is a sectional side view of a joystick apparatus in an embodiment of the present invention having pushbutton and rotation features.
Figure 3B:
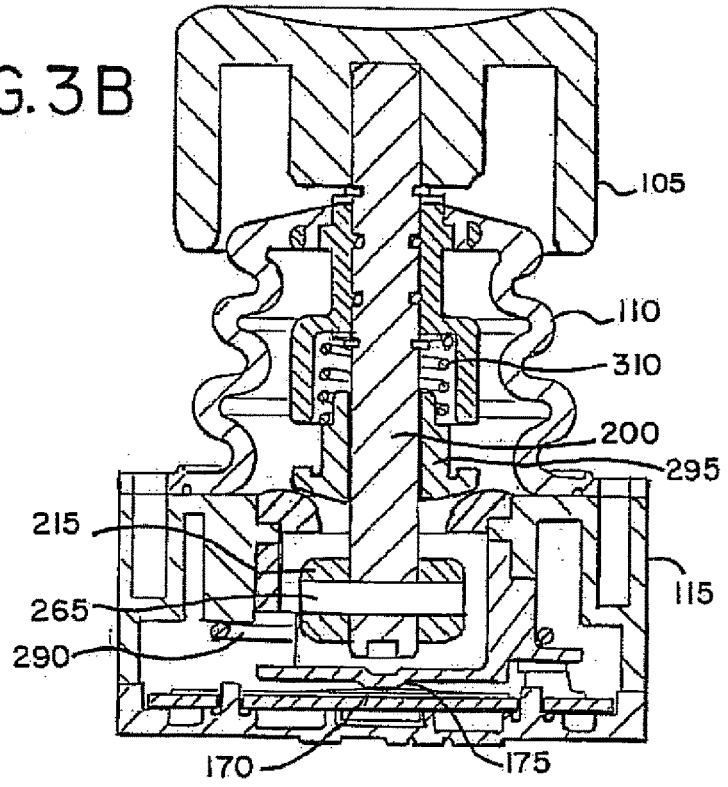
FIG. 3B is a sectional side view of a joystick apparatus in an embodiment of the present invention having pushbutton and rotation features.
Figure 4A:
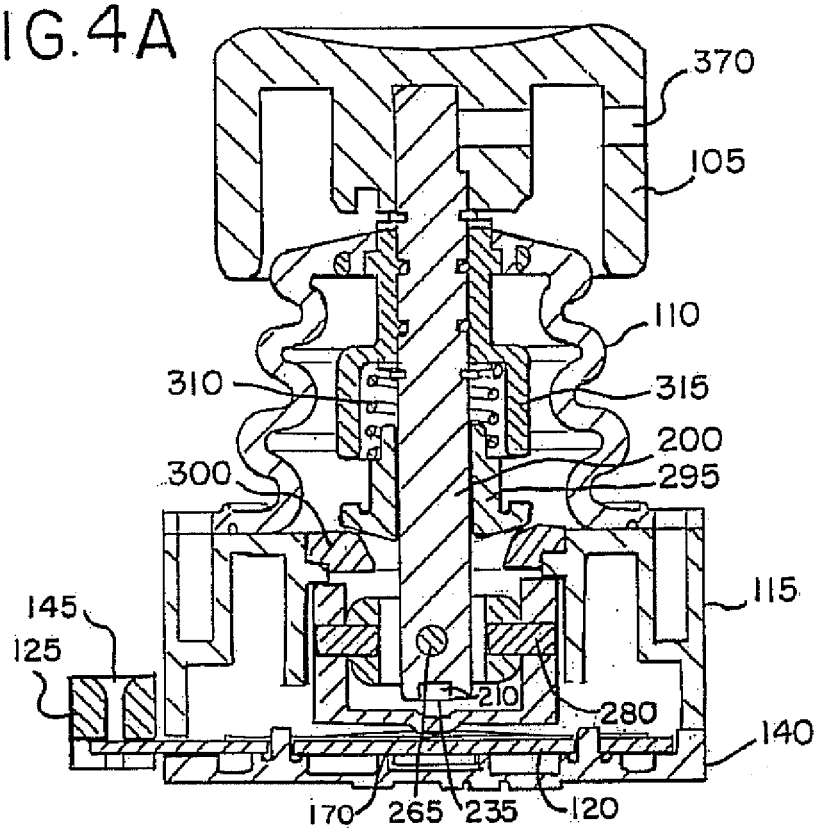
FIG. 4A is a sectional side view of a joystick apparatus having pushbutton and non-rotation features in an embodiment of the present invention.
Figure 4B:
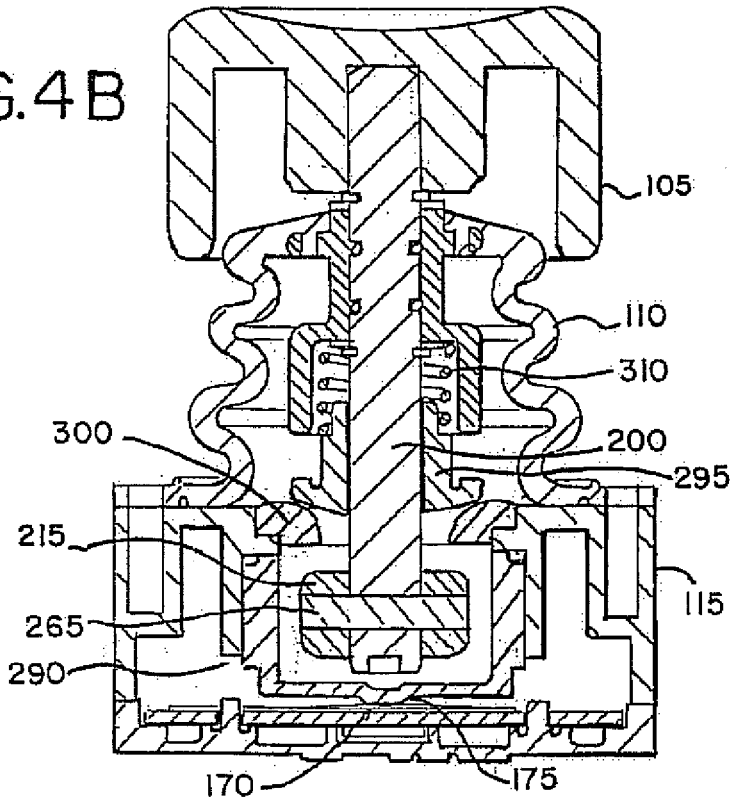
FIG. 4B is a sectional side view of a joystick apparatus having pushbutton and non-rotation features in an embodiment of the present invention.
Figure 5A:
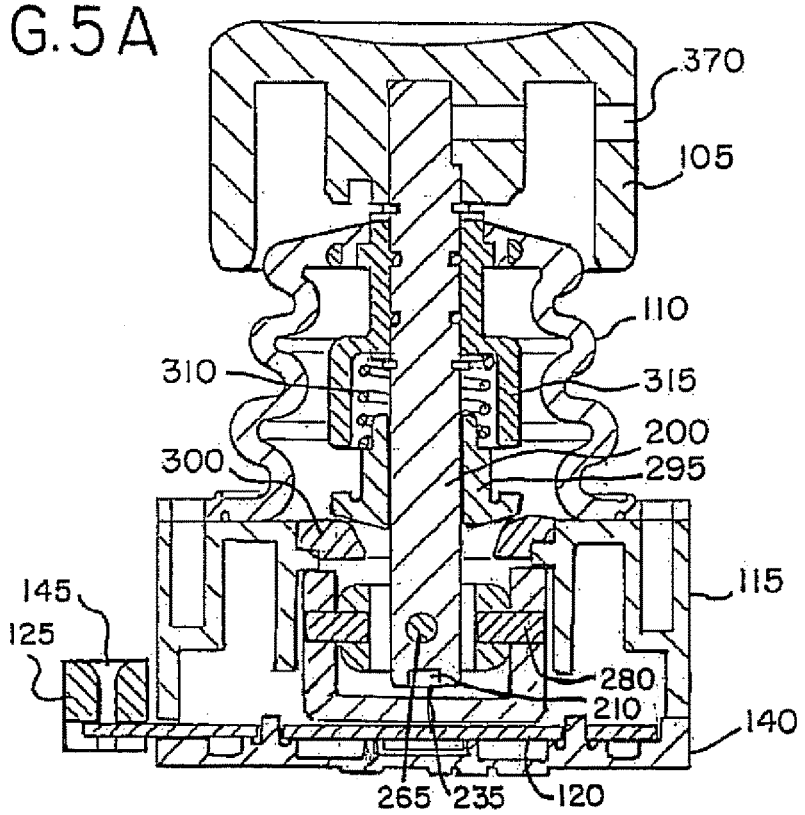
FIG. 5A is a sectional side view of a joystick apparatus having non-pushbutton and non-rotation features in an embodiment of the present invention
Figure 5B:
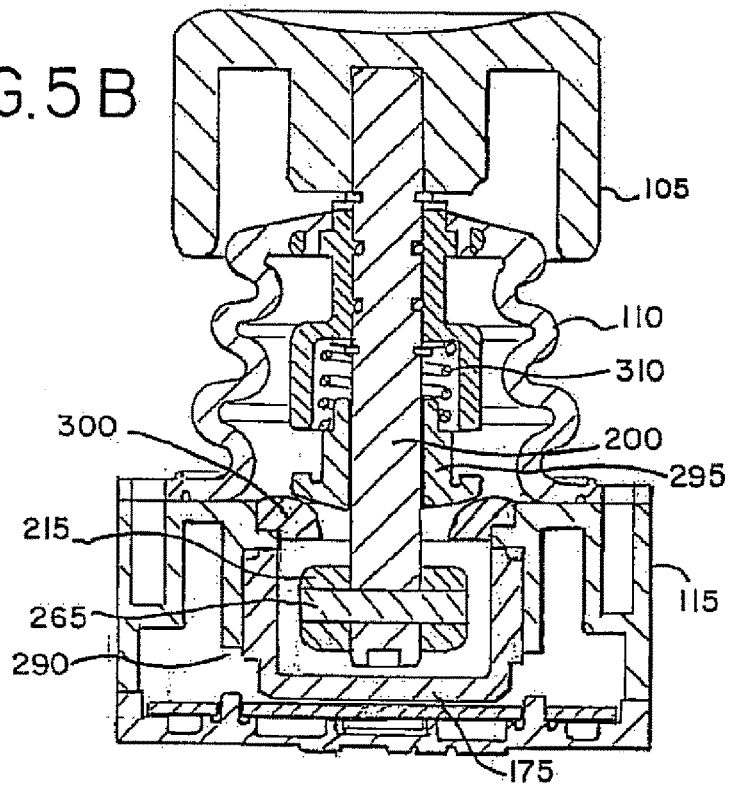
FIG. 5B is a sectional side view of a joystick apparatus in an embodiment of the present invention having non-pushbutton and non-rotation features.

As shown in FIG. 1, the U-joint slider 175 may be arranged above the PCB 120. The U-joint slider 175 may be made from plastic. Numerous embodiments of the U-joint slider 175 may be used in the joystick apparatus 100 of the present invention to provide various operations and/or features. One embodiment of the U-joint slider 175 may provide joystick operations of pushbutton and rotation. Cross sectional views of this embodiment are shown in FIGS. 3A and 3B. Another embodiment may provide joystick operations of pushbutton and non-rotation. Cross-sectional views of this embodiment are shown in FIGS. 4A and 4B. A further embodiment of the U-joint slider 175 may provide joystick operations of non-pushbutton and non-rotation. Cross sectional views of this embodiment are shown in FIGS. 5A and 5B. The non-pushbutton, non-rotation embodiment of the U-joint slider 175 is the part to which the U-joint rocker 215 may be attached. The non-pushbutton, non-rotation embodiment is not a moving part after assembly to the joystick apparatus 100.

The pushbutton and rotation embodiment of the U-joint slider 175 shown in FIGS. 3A and 3B is the attachment point for the U-joint rocker 215 and may be capable of sliding up and down inside the joystick housing 115. As a result, the U-joint slider 175 may function as an actuator for the dome contact 170. This embodiment also features the reflector 255 that protrudes from one side of the U-joint slider 175 and may activate the optical switches 250 on the rotating embodiment of the joystick apparatus 100. As shown in FIG. 1, the two optical switches 250 on the PCB 120 may be located on either side of a center position. When the shaft 200 is located in that center position, the reflector 255 on the U-joint slider 175 may be above and/or between the two optical switches 250. When a user rotates the shaft 200 one way or the other, the reflector 255 may rotate along with the U-joint slider 175 until the reflector 255 is directly above one of the optical switches 250, at which point, an electrical circuit associated with, for example, the shaft 200, the reflector 255, the optical switch 250, and/or the U-joint slider 175, may be closed. Turning the shaft 200 in the opposite direction may activate the other optical switch 250. During a rotation actuation, a torsion spring 290 that may be engaged between the joystick housing 115 and the U-joint slider 175 may be loaded until the actuation is released. As a result, the torsion spring 290 may return the U-joint slider 175 to its center rotational position. In an embodiment of the rotating version of the joystick, the housing 115 and the rotating version of the U-joint slider 175 may set the physical stop or the number of degrees the shaft 200 may rotate through before coming to a hard stop, at which point no further rotation is possible.

The pushbutton and non-rotation embodiment of the U-joint slider 175 has the attachment point for the U-joint rocker 215; however, but the U-joint slider 175 may be capable of sliding up-and-down inside the joystick housing 115. As a result, the U-joint slider 175 may function as an actuator for the dome contact 170 on pushbutton embodiments of the joystick apparatus 100 as shown in FIGS. 4A and 4B.

The joystick housing 115 may provide attachment, assembly and/or location features for a shaft gater 300, the assembly studs 155, the U-joint slider 175 and the backplate 140. The joystick housing 115 may also have poka-yoke keying features to prevent any misalignment during assembly. As a result, any given component may only be assembled to the joystick housing 115 in one way, and any incorrect orientations may not be allowed.

The joystick housing 115 may be configured in numerous embodiments. One embodiment of the housing 115 may be utilized for non-rotating embodiments of the joystick apparatus 100 (such as those shown in FIGS. 4A and 4B and FIGS. 5A and 5B), and another embodiment of the housing 115 may be utilized for rotating embodiments of the joystick apparatus 100 (such as those shown in FIGS. 3A and 3B). The non-rotating embodiments may have keying features that may allow the U-joint slider 175 to move along the axis of the shaft 200 for pushbutton actuation, but the keying features may prevent any unwanted rotation of the U-joint slider 175 relative to the joystick housing 115. Conversely, the rotating embodiment of the joystick housing 115 may have features that allow axial sliding as well as rotation of the U-joint slider 175 relative to the joystick housing 115. In the rotating embodiment of the joystick, the housing 115 may provide location features and/or pre-load the torsion spring 290. Also, in the rotating embodiment of the joystick, the housing 115 and the rotating version of the U-joint slider 175 may set the physical stop, or the number of degrees the shaft may rotate before coming to a hard stop, at which point no further rotation may be possible.

The torsion spring 290 may be made from music wire. The torsion spring 290 may be used on rotating versions of the product. The torsion spring 290 may be pre-loaded and/or engaged between the joystick housing 115 and the U-joint slider 175. The pre-loading is substantially equal and substantially opposite in the clockwise direction and/or the counter-clockwise direction. As a result, the torsion spring 290 may hold the U-joint slider 175 and other parts in the center rotational position until a user may actuate the rotation feature by turning the knob 105. As the knob 105 is turned, the torsion spring 290 may be loaded that may provide a haptic resistance to the user. When the shaft 200 is released from a rotated position, the torsion spring 290 may relax to its nominal pre-loaded position that may return the shaft 200 to its center rotational position.

FIG. 1 illustrates additional components of the joystick apparatus 100. For example, a centering plunger 295 may be fitted over the shaft 200 and may be assembled between the shaft gater 300 and a compression spring 310. The compression spring 310 may be made from music wire. The compression spring 310 may provide the return-to-center function, as well as providing the actuation force for the joystick apparatus 100. The compression spring 310 may be installed between a sealing boot insert 315 (shown in FIG. 3A) and the centering plunger 295. Upon joystick actuation, the geometry of the shaft gater 300 may force the centering plunger 295 upward along the shaft 200 may compress the compression spring 310. When the actuation is released, the compression spring 310 may exert force onto the centering plunger 295 which may force the shaft 200 to its center position.

As shown in FIG. 1, the shaft gater 300 may fit within the joystick housing 115. The shaft gater 300 may have notches 317 that correspond to tabs 320 in the joystick housing 115 to facilitate alignment during assembly. The shaft gater 300 may be made from plastic. The shaft gater 300 may also have an opening 325. The shaft 300 may pass through the opening 325. The shaft gater 300 may be assembled to the joystick housing 115 and may limit the travel of the shaft 200 to allow certain ranges of motion.

In various embodiments, different shaft gaters 300 may be available. One type of shaft gater 300 is a two-way gater which may allow side-to-side movement of the shaft 300. Another type of shaft gater 300 is a four-way gater which may allow side-to-side and up-and-down motion. Finally, a third type of shaft gater 300 is an all-way gater which is circular in shape and may limit the travel to the nominal maximum angle of twenty degrees in any direction. In the various embodiments, all of the shaft gaters may limit the shaft travel to twenty degrees maximum along their allowable axes of motion. However, the two-way shaft gaters may further restrict the motion to allow side-to-side motion, whereas the four-way shaft gaters may further restrict the motion to allow side-to-side and up-and-down motion. Another function of the shaft gater 300 is to provide a bearing surface for the centering plunger 295 to ride. During joystick actuation, the geometry of the shaft gater 300 forces the centering plunger 295 upward along the shaft 300 that may compress the compression spring 310. When the actuation is released, the compression spring 310 may exert force onto the centering plunger 295 which may force the shaft 200 to its center position.

Further, as shown in FIG. 1, the joystick apparatus 100 may have O-rings 330 that may be made from silicone or fluorosilicone rubber. The O-rings 330 may create a dynamic seal between the shaft 200 and the sealing boot insert 315. This seal provided by the 0-ring 330 may allow pushbutton, joystick, and/or rotational motion without significant impact on the haptics of the switch.

The joystick apparatus 100 may also have C-clips 335 that may be made from steel. The C-clips 335 may be installed in an upper position and a lower position on the shaft 200 to keep the sealing boot insert 315 from moving undesirably along the length of the shaft 200. Such placement of the C-clips 335 may ensure that the 0-rings 330 may be engaging to the sealing boot insert 315, and a seal may be maintained.

The joystick apparatus 100 may also have washers 340 that may be made from steel. The washers 340 may be installed between the C-clips 335 and the sealing boot insert 315. The washers 340 may create a complete 360 degree bearing surface for the sealing boot insert 315, as opposed to resting on the C-clips 335 directly, which do not offer as much bearing surface.

The sealing boot 110 may be made from silicone rubber and may be overmolded onto a plastic insert 350. The silicone rubber material may provide a flexible shaft and panel seal that may move with the joystick actuation. The plastic insert 350 may provide a smooth surface to which the shaft 200 and the O-rings 330 may seal to provide the shaft seal. When mounted in an application for a customer, for example, a flat, bottom portion 360 of the sealing boot 110 may be sandwiched between the joystick housing 115 and the customer's panel (not shown). This configuration forms the panel seal, and in conjunction with the shaft seal described above, may allow for an IP67 seal rating, which may maintain integrity even when the joystick functions are being actuated. The plastic insert 350 may also provide a shroud around the compression spring 310 and may set the fixed upper-stop for the compression spring 310. The compression spring 310 may be installed between the sealing boot insert 350 and the centering plunger 295. On joystick actuation, the centering plunger 295 may be forced upward along the shaft 200 that may compress the compression spring 310. When the actuation is released, the compression spring 310 may exert force onto the centering plunger 295, which may force the shaft 200 to its center position.

Further, the knob 105 may be made from plastic. The knob 105 may attach to the shaft 200 and may be held fixedly in place by tightening a set screw (not shown) in a hole 370 in the side of the knob 105 (shown in FIG. 3A).

In an embodiment of the invention, the joystick apparatus 100 may be a proportional output joystick which provides an X,Y coordinate (approximately 0-80) proportional to the joystick location. The X,Y coordinates may be read from the joystick via an $I^2C$ bus. Features of the embodiment may include the proportional operation of the joystick and the $I^2C$ interface, although other interfaces may be used. With an $I^2C$ interface, the joystick apparatus 100 may communicate over an $I^2C$ bus (2-wire bi-directional serial interface). The host CPU (master) must initiate the data transfers, since the joystick apparatus 100 is a slave device. In an embodiment, the $I^2C$ bus may have a low operating current, for example, 3 mA, max.@ VDD=3.3V. Alternatively, an embodiment of the joystick apparatus 100 may also have a low power "sleep mode" that may operate at 100 pA, max. @ VDD=3.3V. In the full power mode, power consumption may be higher. As long as the joystick position is outside of the "sleep zone" (shown in FIG. 11), the joystick apparatus 100 may operate in the full power mode.

Figures 6, 7A, 7B, 7C:
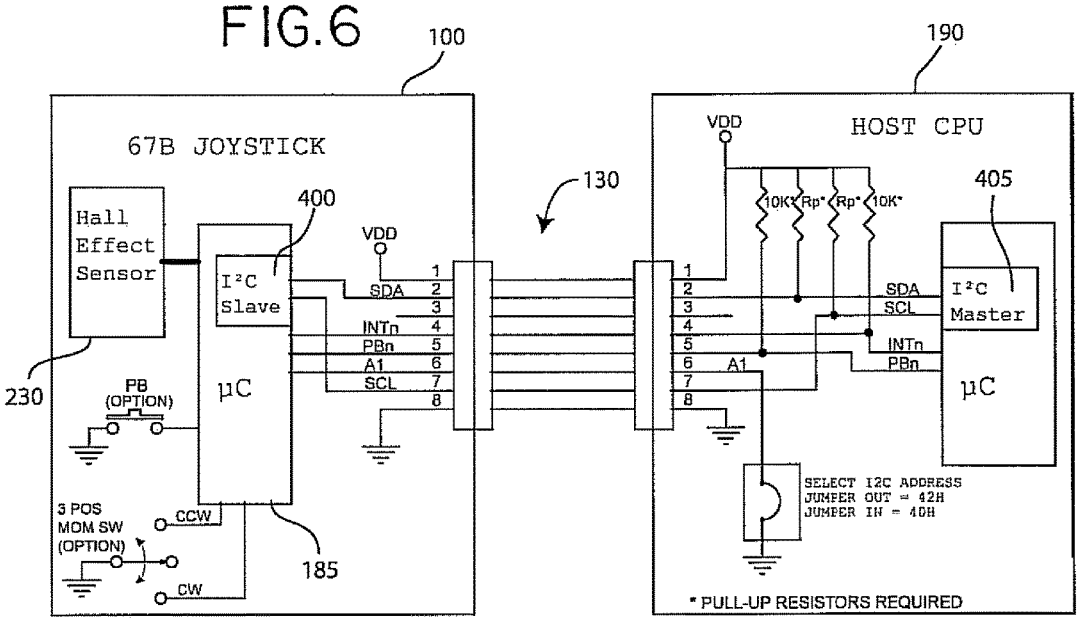
FIG. 6 is a schematic diagram of electrical connections in an embodiment of the present invention.
FIG. 7A illustrates Bits 7-0 of an X register of the $I^2C$ registers in an embodiment of the present invention.
FIG. 7B illustrates Bits 7-0 of a Y register of the $I^2C$ registers in an embodiment of the present invention.
FIG. 7C illustrates Bits 7-0 of a control register of the $I^2C$ registers in an embodiment of the present invention.

Turning now to the electrical connections and communication aspects of the joystick apparatus 100, FIG. 6 illustrates an electrical connection diagram of an embodiment of the invention. In an embodiment, the joystick apparatus 100 may communicate over an $I^2C$ bus (2-wire bi-directional serial interface). As shown, the joystick apparatus 100 may be an $I^2C$ slave 400 with 7 bit $I^2C$ address of 80h (A1n floating) or 82h (A1n tied to Ground, GND). The host CPU 190 is a master device 405 and as such, must initiate the data transfers, since the joystick apparatus 100 is the slave device 400. The $I^2C$ speed may be up to 400 kHz in an embodiment.

FIG. 6 also illustrates the electrical connections of the microcontroller 185 and the Hall effect IC 230 that may be mounted to the bottom surface 173 of the PCB 120 of the joystick apparatus 100. Further, the cable assembly 130 may connect the joystick apparatus 100 to the host CPU 190. FIG. 6 illustrates a hardware interface between the joystick apparatus 100 to the host CPU 190.

As shown in FIG. 6, the cable assembly 130 of the joystick apparatus 100 may be a header or a ribbon cable with a connector. For example, a ribbon cable with a Tyco 7-215083-6 connector (Mating header: Tyco 7-215079-6) may be used. Further, a header may be used. For example, a (1×8) header having 0.10" centers with 0.025" square pins may be used. In an embodiment, the connector signals may be as follows in Table 1:

TABLE 1

| Pin # | Signal | I/O | Description |
|---|---|---|---|
| 1 | VDD | — | Power Supply |
| 2 | SDA | I/O | $I^2C$ Data Line |
| 3 | | | Spare |
| 4 | INTn | Out | Interrupt Out. Open Drain. Active Low. |
| 5 | Pbn | Out | Pushbutton Out. Open Drain. Active Low. |
| 6 | A1n | In | A1n (LSB) of 7 bit $I^2C$ address |
| 7 | SCL | In | $I^2C$ Clock Line |
| 8 | VSS | — | Ground |

Pull-Up Resistors $I^2C$ Signals (SCL, SDA) may require external pull-up resistors, Rp. The connection of the resistors is shown in FIG. 6. Two $I^2C$ signals (SDA & SCL) may be pulled up to the power supply voltage at the host CPU 190. The pull-up resistor value depends on the bus capacitance and SCL frequency. Table 2 below shows the recommended pull-up resistor values vs. SCL frequency and bus capacitance:

TABLE 2

| | Rp recommended Bus Load capacitance | | | |
|---|---|---|---|---|
| SCL Frequency | 100 pF | 200 pF | 300 pF | 400 pF |
| Standard mode (100 kHz) | 6.49 kΩ | 3.48 kΩ | 2.49 kΩ | 2 kΩ |
| Fast mode (400 kHz) | 2.26 kΩ | 1.4 kΩ | 1.1 kΩ | — |

For example, when operating in the standard mode at 100 kHz with a bus load capacitance of 200 pF, the recommended Rp value for the pull-up resistors Rp for $I^2C$ signals SDA & SCL is 3.48 kΩ. Also, the pull-up resistor for the INTn signal shown in FIG. 6 may be a recommended value of 2 kΩ-10 kΩ. The INTn (Interrupt Out (Active Low)) may go low only when a different X, Y value is available. Reading the Y value may cause INTn to go high (inactive). For most efficient use of the $I^2C$ bus and processor resources, the INTn signal may be used to trigger reading of the X, Y value from the joystick. If INTn is not used, the X and Y values may be read continuously at a rate of 50 samples/sec. Thus, an external pull-up resistor in the range of 2 kΩ-10 kΩ (see FIG. 6) may be required for INTn.

To determine if a proper pull-up value has been selected, one checks the low and high voltage levels for SCL and SDA during $I^2C$ bus activity. The signal levels may meet the following requirements with at least a 0.1V margin:

VL, MAX<0.3 VDD

VH, MIN>0.7 VDD

Cable/PCB Trace Length

The Cable/PCB Trace Length may vary with $I^2C$ frequency. The $I^2C$ specification specifies a maximum capacitance per signal line (SCL or SDA) of 400 pF. The bus capacitance is the total of wire, PCB traces and pins. A longer cable/PCB trace length may result in a higher bus capacitance. As a result, a lower operating frequency may be used.

$I^2C$ Interface

As previously set forth, the joystick apparatus 100 may, for example, communicate over an $I^2C$ bus (2-wire bi-directional serial interface) in an embodiment. Also, the joystick apparatus 100 may communicate via other interfaces such as SPI and/or analog out, for example. The host CPU 190 is the master device 405 and as such, must initiate the data transfers since the joystick apparatus 100 is the slave device 400.

$I^2C$ Address

The $I^2C$ address may consist of 7 bits (D7-D1) and a bit (D0) indicating whether the bit is a Read (1) or Write (0) cycle. The joystick apparatus 100 may be provided from the factory with the 7-bit device $I^2C$ address of 80H ('1000 000X') when A1n (pin 6) is left floating (not connected). The $I^2C$ address may be changed to 82H by pulling A1n to Gnd. If A1n is changed after power-up then a reset command may be sent to the joystick to make active the new value (A1n is only read by the joystick after a power-up or reset command). Changing the $I^2C$ address may be necessary if two joystick apparatus 100 joysticks are connected to the same $I^2C$ bus or if another component is connected to the $I^2C$ bus shared the same $I^2C$ address. In another embodiment, a custom $I^2C$ address may be used.

SDA is a bi-directional signal and is used to read and write the serial data. The SCL signal is the clock generated by the host CPU, to synchronize the SDA data in read and write mode. The maximum $I^2C$ clock frequency is 400 KHz with data triggered on the rising edge of SCL.

The $I^2C$ bus may also have clock stretching. Clock stretching may occur when a device on the bus holds the SCL line low effectively pausing communication. The $I^2C$ slave 400 of the joystick apparatus 100 may stretch the clock to allow more time to load data to be read by the master device 405 in the host CPU 190. The $I^2C$ master 405 may interface with the joystick apparatus 100 to implement clock stretching on a byte level for reliable operation with the joystick.

$I^2C$ Registers

X Register

FIG. 7A shows the X-coordinate with Bit 7-0 of the X-register of the $I^2C$ registers. The reset value is 0000 0000. The X coordinate may be in 2's complement format (signed −128 to +127). After a complete $I^2C$ transaction, the register pointer in the joystick may point at the X-register so that an X-register value may be read without writing to register pointer as described in the read cycle and the write cycle below. To keep the X-value and Y-value paired or "in sync", the X-register data may be read in an $I^2C$ sequence which may read the X-register and the Y-register as described in the read and write cycles hereinafter and in FIG. 8.

Y Register

FIG. 7B shows the Y-coordinate with Bit 7-0 of the Y-register of the $I^2C$ registers. The reset value is 0000 0000. The Y coordinate may be in 2's complement format (signed −128 to +127). Reading the Y-register will reset INTn output to Hi-Z. The Y-register should be read in a single $I^2C$ sequence that reads the X-register first followed by the Y-register as described in the read and write cycles hereinafter and in FIG. 8.

Control Register (76h)

FIG. 7C shows the control register with Bit 7-0 of the control register of the $I^2C$ registers. The reset value is 1001 1010 (9Ah), and the symbol X in FIG. 7C means Do Not Care. Writing to this register with Reset (Bit 1) high may reset the joystick and sets the registers to default values. The reset bit may be set low by the joystick after completing the reset sequence. A start-up time ($T_{P,W}$) may be observed after resetting the joystick.

$I^2C$ Read and Write Cycles

Read X & Y Values

Figure 8:
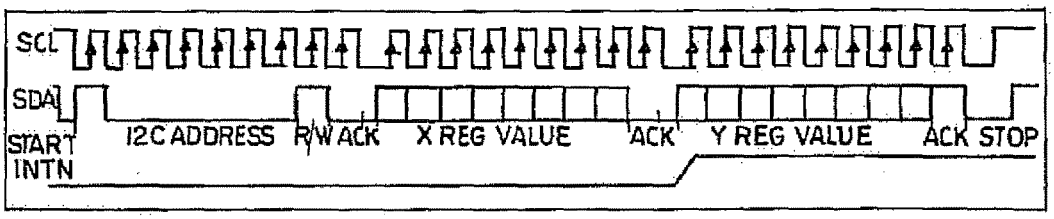
FIG. 8 is a schematic diagram illustrating the reading the X and Y values over an $I^2C$ bus in an embodiment of the present invention.
Figure 9:
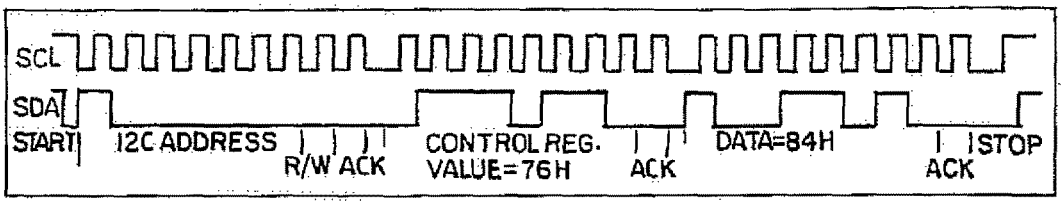
FIG. 9 is a timing diagram illustrating the sending a reset command over an $I^2C$ bus in an embodiment of the present invention.
Figure 10:
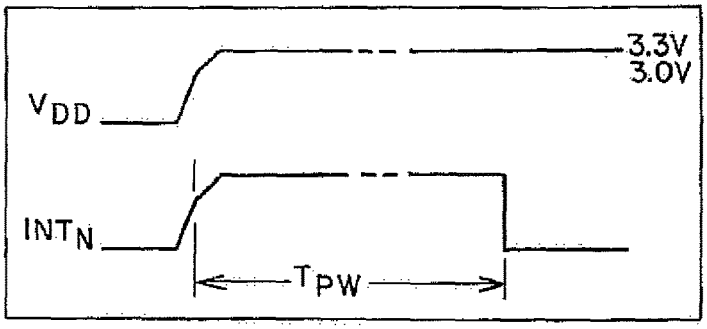
FIG. 10 is a timing diagram of a power up sequence in an embodiment of the present invention.

When INTn goes low, new X and Y values may be available. To read the X and Y values, the external $I^2C$ master 405 on the host CPU 190 should perform a read sequence of two bytes without providing a register address. The joystick apparatus 100 may send the X-register value followed by the Y-register value for any two byte read without a register address. INTn will go high (inactive) at the beginning of the read of the Y-value (FIG. 8).

$I^2C$ Start Command 81h or 83h (Joystick $I^2C$ Address with D0 set for read)

X Byte (Data from Joystick)

Y Byte (Data from Joystick)

$I^2C$ Stop Command

If a new X and Y value is available before the previous values are read, the new values may over-write the old with the loss of the oldest values. However, to keep the X and Y values paired or "in sync", the user may read the X and Y values in the single $I^2C$ sequence as shown in FIG. 8. Operation in this manner may provide the fastest and most efficient use of the $I^2C$ bus.

Power Modes & Sleep Threshold

Power Up Sequence

In an embodiment, during a power-up after the power supply voltage reaches 3.0V, a user may wait the nominal startup time ($T_{P,W}$) before communicating with the joystick over the $I^2C$ bus. This wait may also apply to a reset joystick command. At the end of the nominal wakeup time, the joystick apparatus 100 may generate the first pair of XY values and sets INTn low. Thereafter, INTn goes low if the X-value or the Y-value changes.

Full Power Mode

In this mode, an internal measurement occurs every 20 ms. If the X-value or the Y-value changes from the last values output, the INTn output (Pin 5) is set low signaling a new X-value and a new Y-value may be ready to be read. INTn is cleared (Hi-Z) while the Y-value is read. Power consumption is higher in this mode. As long as the joystick position is outside of the "sleep zone", the joystick apparatus 100 will operate in this mode. Power consumption may be higher in this mode.

Low Power (Sleep) Mode

Figure 12:
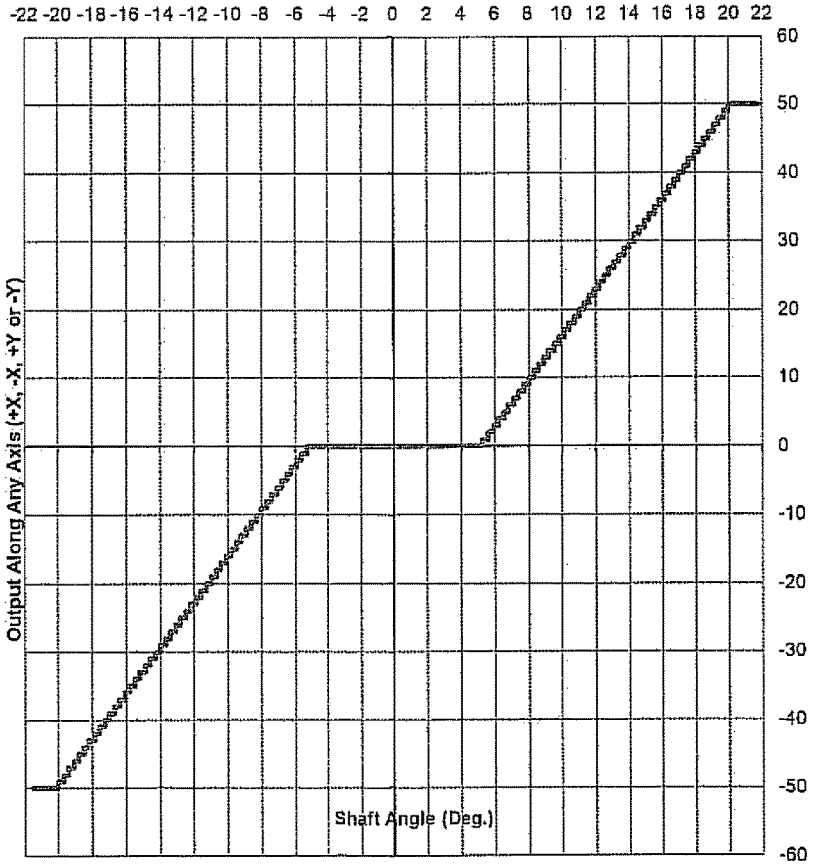
FIG. 12 is a graphical representation of a joystick output along the X and Y axes versus the angle of the shaft in an embodiment of the present invention.
Figure 13:
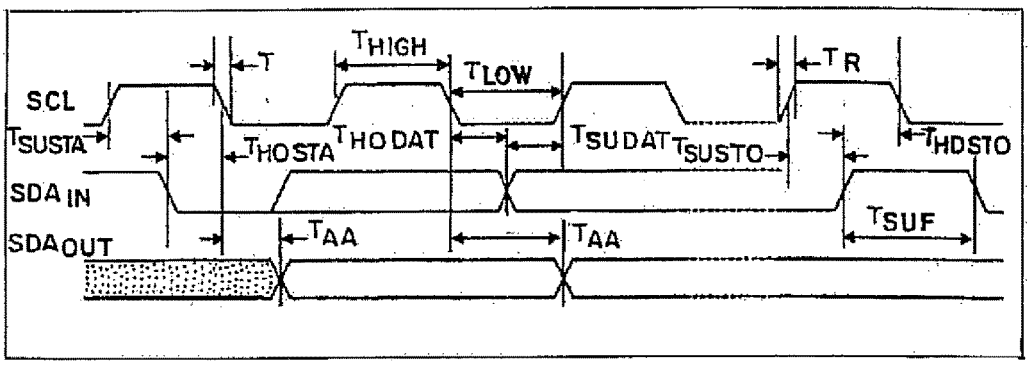
FIG. 13 is a schematic diagram illustrating data requirements of an $I^2C$ bus in an embodiment of the present invention.
Figure 14:
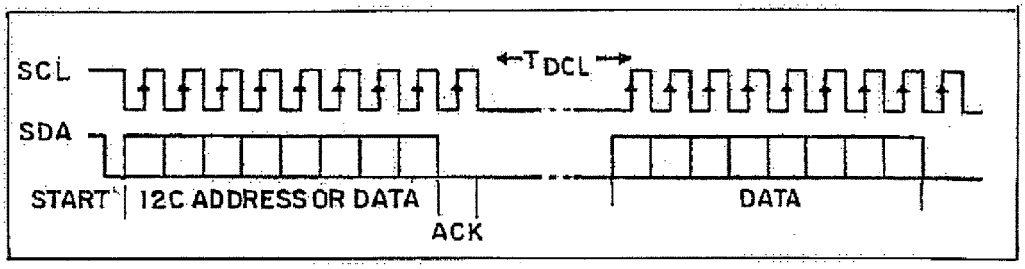
FIG. 14 is a schematic diagram illustrating clock stretching by a joystick in an embodiment of the present invention.

FIG. 11 illustrates an embodiment of a low power (sleep) mode. When the joystick position for both X and Y is within a circle defined as the "sleep zone" for ten consecutive measurements, the joystick may operate in the low power mode where power may be lower. The "sleep zone" may extend to a joystick shaft angle of 5° from the center as shown in FIG. 11. Also, FIG. 12 shows output along +X, −X, +Y or −Y axis vs. shaft angle in degrees.

In an embodiment, the joystick apparatus 100 may operate in a low power (sleep) mode. The last X,Y value output before entering the Low power mode is (0,0). As long as the shaft 200 of the joystick apparatus 100 remains within the circle defined by the threshold, the joystick apparatus 100 may remain in the low power mode. When the shaft 200 of the joystick apparatus 100 is moved outside of the "sleep zone" circle, the joystick apparatus 100 may return to the full power mode, new X,Y measurements may be available every 20 ms and power consumption may increase. Low power (sleep mode) current may be higher if supply voltage drops below 2.9V.

Other variations and/or geometric configurations which are known to one having ordinary skill in the art are possible and are deemed to be within the scope of this disclosure. The materials used for the components of the joystick apparatus 100 may be selected from any suitable material to perform the desired function for operation of the joystick apparatus 100. The materials must also be capable of withstanding environmental conditions that may be encountered. Considerations of performance and/or reliability are also important in the selection of the material. Other materials which are known to one having ordinary skill in the art may be selected and are deemed to be within the scope of this disclosure. Further, known bonding techniques that are suitable for the type of material selected are considered to be within the scope of this disclosure.

As disclosed above, the joystick apparatus 100 may also be manufactured in numerous embodiments. The various embodiments of the joystick apparatus 100 may have additional components which may provide enhanced functionality of the joystick apparatus 100.

Moreover, the present invention is not limited to the specific arrangement of the components of the joystick apparatus 100 illustrated in the figures. It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the appended claims.

We claim:

1. A joystick apparatus comprising:

a housing;

a printed circuit board in the housing;

a U-joint assembly above the printed circuit board in the housing wherein the U-joint assembly has a U-joint rocker pivotably connected to a U-joint slider;

a reflector at a center position on the U-joint slider;

a shaft having a first end, a second end and a center position, wherein the second end is pivotably connected to the U-joint rocker to allow movement of the shaft relative to the center position within a circle, and wherein the movement of the shaft is in at least one of a forward and a backward direction, a side-to-side direction, an axial direction, or a rotating direction, to provide an end user with selectable functionality;

a knob on the first end of the shaft;

a magnet on the second end of the shaft;

a Hall effect integrated circuit on the printed circuit board wherein the Hall effect integrated circuit detects movement of the magnet in response to corresponding movement of the shaft and further wherein the Hall effect integrated circuit generates a corresponding proportional joystick output signal indicative of the direction of movement of the shaft and an extent of deflection of the shaft;

the apparatus further comprising a dome contact on the printed circuit board wherein the U-joint slider contacts the dome contact to close an electrical circuit in response to the end user pressing axially on the knob;

a concentric reduced power zone circle within the circle of movement of the shaft wherein operation of the shaft within the reduced power zone circle uses less power than operation outside of the reduced power zone circle; and a first optical switch and a second optical switch on the printed circuit board, wherein each of the first optical switch and the second optical switch is arranged on a respective side of the center position of the reflector, and wherein each of the first optical switch and the second optical switch closes an electrical circuit associated with the first optical switch and the second optical switch in response to the end user rotating the knob to align the reflector with one of the first optical switch and the second optical switch.

2. The apparatus of claim 1 wherein the circle of movement of the shaft facilitates the generation of a non-distorted maximum joystick output signal.

3. The apparatus of claim 1 wherein the U-joint slider is configured to slide vertically in the housing in response to a user axially pressing the knob.

4. The apparatus of claim 1 further comprising:

a torsion spring between the housing and the U-joint slider to return the shaft to the center position in response to a user rotating the knob.

5. The apparatus of claim 1 further comprising:

a shaft gater on the housing wherein the shaft passes through an opening in the shaft gater.

6. The apparatus of claim 1 further comprising:

a slave microcontroller associated with the printed circuit board.

7. The apparatus of claim 1 further comprising:

a sealing boot having an opening and a lip, wherein the first end of the shaft passes through the opening, and the lip abuts the housing.

8. The apparatus of claim 1 further comprising:

a sealing boot overmolded onto an insert, wherein the sealing boot is silicone rubber, and the insert is plastic.

9. The apparatus of claim 1 further comprising:

a centering plunger on the shaft; and a spring on the centering plunger to return the shaft to the center position in response to a user moving the shaft.

10. The apparatus of claim 1 further comprising:

keying features in the housing to facilitate alignment during assembly.

11. The apparatus of claim 1 further comprising:

keying features to allow the U-joint slider to move axially along the shaft axis and to restrict rotation of the U-joint slider relative to the housing for pushbutton operation.

12. The apparatus of claim 1 further comprising:

keying features to allow the U-joint slider to move axially along the shaft axis for pushbutton operation and to allow rotation of the U-joint slider relative to the housing for rotation operation.

* * * * *